US005636979A

United States Patent [19]

McDonough et al.

[11] Patent Number: 5,636,979

[45] Date of Patent: *Jun. 10, 1997

[54] SELECTIVELY ACTUATABLE LIGHTER

[75] Inventors: James M. McDonough, Guilford, Conn.; Michel Doucet, Bains/S/Oust, France

[73] Assignee: BIC Corporation, Milford, Conn.

[ * ] Notice: The term of this patent shall not extend beyond the expiration date of Pat. No. 5,456,598.

[21] Appl. No.: 443,569

[22] Filed: May 22, 1995

Related U.S. Application Data

[63] Continuation of Ser. No. 723,989, Jul. 1, 1991, Pat. No. 5,456,598, which is a continuation-in-part of Ser. No. 609, 668, Nov. 6, 1990, abandoned, which is a continuation of Ser. No. 239,734, Sep. 2, 1988, Pat. No. 5,002,482.

[51] Int. Cl.[6] ..... F23D 11/36

[52] U.S. Cl. ..... 431/153; 431/277

[58] Field of Search ..... 431/153, 255, 431/277

[56] References Cited

U.S. PATENT DOCUMENTS

| | | | |
|---|---|---|---|
| Re. 33,282 | 7/1990 | Schachter | 431/344 |
| 1,599,894 | 9/1926 | Jach . | |
| 1,895,032 | 1/1933 | Fisher . | |
| 2,520,328 | 8/1950 | Nissen | 431/153 |
| 2,637,577 | 5/1953 | Wiessner | 292/122 |
| 2,727,376 | 12/1955 | Felt | 67/7.1 |
| 2,737,037 | 3/1956 | Zellweger . | |
| 2,806,520 | 9/1957 | Adams | 158/73 |
| 3,169,672 | 2/1965 | Soffer et al. | 222/153 |

(List continued on next page.)

FOREIGN PATENT DOCUMENTS

| | | | |
|---|---|---|---|
| 368619 | 2/1982 | Australia | F23Q 2/34 |
| 284701 | 10/1988 | European Pat. Off. | F23D 14/42 |
| 296281 | 12/1988 | European Pat. Off. | F23Q 2/16 |
| 372989 | 6/1990 | European Pat. Off. | F23Q 2/46 |
| 479318A2 | 4/1992 | European Pat. Off. | F23Q 2/16 |
| 485305A1 | 5/1992 | European Pat. Off. | F23Q 2/28 |
| 488158A2 | 6/1992 | European Pat. Off. | F23Q 2/16 |
| 446162A1 | 9/1992 | European Pat. Off. | F23Q 2/28 |
| 2198092 | 3/1974 | France | F23Q 2/00 |
| 2259320 | 8/1975 | France | F23Q 2/16 |
| 2280029 | 3/1976 | France | F23Q 2/16 |
| 2397599 | 2/1979 | France | F23Q 2/34 |
| 2446991 | 8/1980 | France | F23Q 2/32 |
| 2470337 | 5/1981 | France | F23Q 2/16 |
| 2519740 | 7/1983 | France | F23Q 2/30 |
| 2520487 | 7/1983 | France | F23Q 2/173 |
| 2622279 | 4/1989 | France | F23Q 2/16 |

(List continued on next page.)

OTHER PUBLICATIONS

WO9000239, Jan. 1990, Ansquer.

*Primary Examiner*—Carl D. Price
*Attorney, Agent, or Firm*—Pennie & Edmonds

[57] ABSTRACT

A selectively actuatable lighter device is disclosed which includes a body defining reservoir for containing a combustible gaseous medium such as butane, and having a valve arranged to be selectively actuated between a normally closed position and an open position which permits the exit of the gaseous medium. Such lighter can selectively produce sparks at a location proximate to the gaseous medium exit to ignite the gaseous medium. Such lighter device embodies a resiliently releasable latch which normally prevents actuation of a valve actuator to the open position thereby preventing actuation of the valve. The latch is selectively movable to a position out of interference with the valve actuator, so that the gaseous medium may be released and ignited by the sparks. The latch is resiliently structured and mounted such that once a flame is produced and the valve actuator is released, the latch returns to its closed or latched position to prevent actuation of the valve to the open position by prevention of the pivotal motion of the valve actuator. To "re-use" the lighter, the latch must again be moved to an unlatched position so that the valve actuator can be opened for subsequent ignition of the gaseous medium.

9 Claims, 9 Drawing Sheets

U.S. PATENT DOCUMENTS

| | | | |
|---|---|---|---|
| 3,194,435 | 7/1965 | Burchett | 222/3 |
| 3,213,647 | 10/1965 | Sakamoto | 67/7.1 |
| 3,267,988 | 8/1966 | Schott | 158/73 |
| 3,280,599 | 10/1966 | Projahn . | |
| 3,425,782 | 2/1969 | Moylan . | |
| 3,450,143 | 6/1969 | Tamarin | 137/38 |
| 3,547,566 | 12/1970 | Tamarin | 431/88 |
| 3,590,591 | 7/1971 | Genoud | 62/50 |
| 3,601,165 | 8/1971 | Obata | 141/302 |
| 3,612,736 | 10/1971 | Steuernagel et al. | 431/130 |
| 3,622,052 | 11/1971 | Gach | 222/402.11 |
| 3,663,152 | 5/1972 | Yoshida | 431/344 |
| 3,723,048 | 3/1973 | Russell | 431/151 |
| 3,744,953 | 7/1973 | Herr | 431/13 |
| 3,749,286 | 7/1973 | Douglas | 222/153 |
| 3,752,637 | 8/1973 | Norman et al. | 431/274 |
| 3,756,766 | 9/1973 | Green | 431/254 |
| 3,766,946 | 10/1973 | Corarg | 138/44 |
| 3,816,056 | 6/1974 | Brown | 431/253 |
| 3,817,693 | 6/1974 | Sebens et al. | 431/153 |
| 3,828,982 | 8/1974 | Steigerwald | 222/153 |
| 3,885,717 | 5/1975 | Ewald | 222/402.11 |
| 3,894,665 | 7/1975 | Swenson | 222/402.11 |
| 3,898,031 | 8/1975 | Rusakowicz | 431/130 |
| 3,899,285 | 8/1975 | Christmas | 431/152 |
| 3,899,286 | 8/1975 | Lockwood et al. | 431/321 |
| 3,904,088 | 9/1975 | Milbourne, Sr. | 222/402.11 |
| 3,910,752 | 10/1975 | Holl | 431/273 |
| 3,918,614 | 11/1975 | Steiman | 222/153 |
| 3,938,943 | 2/1976 | Malamoud | 431/150 |
| 3,940,023 | 2/1976 | Umstead | 222/153 |
| 3,955,585 | 5/1976 | Fox | 131/186 |
| 3,963,413 | 6/1976 | Lockwood et al. | 431/276 |
| 3,966,392 | 6/1976 | Lockwood | 431/344 |
| 3,985,493 | 10/1976 | Neyret | 431/150 |
| 3,994,666 | 11/1976 | Spinosa et al. | 431/144 |
| 4,003,694 | 1/1977 | Lowell | 431/344 |
| 4,008,992 | 2/1977 | Johnsson | 431/344 |
| 4,024,988 | 5/1977 | Starrett | 222/153 |
| 4,028,043 | 6/1977 | Neyret | 431/144 |
| 4,036,579 | 7/1977 | Marynissen | 431/131 |
| 4,039,274 | 8/1977 | Nordlinger | 431/128 |
| 4,049,370 | 9/1977 | Neyret | 431/144 |
| 4,060,202 | 11/1977 | Neyret | 239/579 |
| 4,080,156 | 3/1978 | Moriya | 431/344 |
| 4,101,262 | 7/1978 | Neyret | 431/344 |
| 4,102,633 | 7/1978 | Zellweger et al. | 431/152 |
| 4,111,638 | 9/1978 | Ostberg | 431/13 |
| 4,144,018 | 3/1979 | Tanaka | 431/131 |
| 4,150,940 | 4/1979 | Heller et al. | 431/130 |
| 4,153,233 | 5/1979 | Neyret | 251/127 |
| 4,157,891 | 6/1979 | Moriya | 431/344 |
| 4,177,646 | 12/1979 | Guadagnin et al. | 62/52 |
| 4,181,490 | 1/1980 | Nitta | 431/129 |
| 4,190,412 | 2/1980 | Nitta | 431/151 |
| 4,224,020 | 9/1980 | Neyret | 431/344 |
| 4,235,588 | 11/1980 | Tanaka | 431/147 |
| 4,235,589 | 11/1980 | Vallera | 431/344 |
| 4,243,377 | 1/1981 | Schmid | 431/344 |
| 4,279,591 | 7/1981 | Aguirre | 431/344 |
| 4,289,478 | 9/1981 | Nitta | 431/344 |
| 4,311,450 | 1/1982 | Camos | 431/344 |
| 4,315,731 | 2/1982 | Moore | 431/254 |
| 4,324,351 | 4/1982 | Meshberg | 222/402.11 |
| 4,325,692 | 4/1982 | Kitabayashi | 431/254 |
| 4,403,945 | 9/1983 | Leitgib | 431/150 |
| 4,413,638 | 11/1983 | Le | 131/174 |
| 4,416,612 | 11/1983 | Tabata | 431/131 |
| 4,432,542 | 2/1984 | Poynter | 272/27 W |
| 4,448,226 | 5/1984 | Dumont | 141/2 |
| 4,457,699 | 7/1984 | Hattori | 431/344 |
| 4,478,570 | 10/1984 | Johansson | 431/344 |
| 4,487,570 | 12/1984 | Lowenthal | 431/130 |
| 4,496,309 | 1/1985 | Schachter | 431/344 |
| 4,509,916 | 4/1985 | Laforest Le Boudec | 431/273 |
| 4,522,583 | 6/1985 | Kraser | 431/126 |
| 4,560,345 | 12/1985 | Schachter | 431/344 |
| 4,601,656 | 7/1986 | Calgaro | 431/344 |
| 4,608,508 | 8/1986 | Ohnishi | 310/339 |
| 4,666,401 | 5/1987 | Royer | 431/344 |
| 4,669,975 | 6/1987 | Martinez | 431/344 |
| 4,680,007 | 7/1987 | Schachter | 431/344 |
| 4,687,437 | 8/1987 | Springer | 431/277 |
| 4,717,335 | 1/1988 | Loveless | 431/277 |
| 4,746,288 | 5/1988 | Graham | 431/344 |
| 4,749,351 | 6/1988 | Mahoney | 431/252 |
| 4,758,152 | 7/1988 | Kordecki | 431/153 |
| 4,773,849 | 9/1988 | Schachter | 431/344 |
| 4,784,601 | 11/1988 | Nitta | 431/153 |
| 4,784,602 | 11/1988 | Nitta | 431/153 |
| 4,786,248 | 11/1988 | Nitta | 431/255 |
| 4,787,329 | 11/1988 | Grossiord | 116/227 |
| 4,799,877 | 1/1989 | Bisbee | 431/153 |
| 4,810,187 | 3/1989 | Nitta | 431/255 |
| 4,822,276 | 4/1989 | Bisbee | 431/153 |
| 4,830,603 | 5/1989 | Cirami | 431/153 |
| 4,832,596 | 5/1989 | Morris, Sr. | 431/153 |
| 4,844,244 | 7/1989 | Mawby | 206/88 |
| 4,844,254 | 7/1989 | Jang | 206/236 |
| 4,844,667 | 7/1989 | Lin | 431/151 |
| 4,850,854 | 7/1989 | Buck | 431/143 |
| 4,854,859 | 8/1989 | Lin | 431/344 |
| 4,859,172 | 8/1989 | Nitta | 431/153 |
| 4,859,174 | 8/1989 | Zellweger et al. | 431/255 |
| 4,869,663 | 9/1989 | Fremund | 431/153 |
| 4,873,752 | 10/1989 | Suck | 29/157 C |
| 4,878,833 | 11/1989 | Nitta | 431/146 |
| 4,878,834 | 11/1989 | Nitta | 431/146 |
| 4,878,836 | 11/1989 | Nitta | 431/277 |
| 4,880,377 | 11/1989 | Ficho | 431/126 |
| 4,884,964 | 12/1989 | Nitta | 431/277 |
| 4,884,965 | 12/1989 | Nitta | 431/277 |
| 4,889,482 | 12/1989 | Schachter | 431/344 |
| 4,904,180 | 2/1990 | Nitta | 431/153 |
| 4,906,179 | 3/1990 | Nitta | 431/264 |
| 4,919,610 | 4/1990 | Nitta | 431/274 |
| 4,921,420 | 5/1990 | Johnston | 431/153 |
| 4,927,747 | 5/1990 | Nitta | 431/344 |
| 4,929,174 | 5/1990 | Wang | 431/276 |
| 4,929,175 | 5/1990 | Nitta | 431/344 |
| 4,929,176 | 5/1990 | Nitta | 431/344 |
| 5,002,482 | 3/1991 | Fairbanks et al. | 431/153 |
| 5,017,128 | 5/1991 | Hunter | 431/277 |
| 5,035,608 | 7/1991 | Parren | 431/277 X |
| 5,044,933 | 9/1991 | Yang | 431/144 |
| 5,055,033 | 10/1991 | Lee | 431/255 |
| 5,055,034 | 10/1991 | Wang | 431/255 |
| 5,059,852 | 10/1991 | Meury | 310/339 |
| 5,066,220 | 11/1991 | Vick | 431/277 |
| 5,074,781 | 12/1991 | Fujita | 431/153 |
| 5,076,783 | 12/1991 | Fremond | 431/153 |
| 5,085,578 | 2/1992 | Hunter | 431/277 |
| 5,090,893 | 2/1992 | Floriot | 431/153 |
| 5,092,763 | 3/1992 | Winiger | 431/276 |
| 5,092,764 | 3/1992 | McDonough et al. | 431/277 |
| 5,096,414 | 3/1992 | Zellweger | 431/277 |
| 5,104,313 | 4/1992 | Zellweger | 431/277 |
| 5,120,215 | 6/1992 | Amoros Nollas | 431/153 |
| 5,120,216 | 6/1992 | Iwahori | 431/254 |
| 5,125,829 | 6/1992 | McDonough et al. | 431/255 |
| 5,129,819 | 7/1992 | Rubin | 431/124 |
| 5,132,517 | 7/1992 | Von Gaisberg et al. | 219/270 |

| | | | |
|---|---|---|---|
| 5,135,388 | 8/1992 | Pettit | 431/254 |
| 5,165,886 | 11/1992 | Frigiere | 431/254 |
| 5,334,011 | 8/1994 | Frigiere | 431/153 |

FOREIGN PATENT DOCUMENTS

| | | | |
|---|---|---|---|
| 2630057 | 10/1989 | France | B60N 3/14 |
| 2632712 | 12/1989 | France | F23Q 2/50 |
| 2633702 | 1/1990 | France | F23Q 2/34 |
| 2210552 | 9/1973 | Germany | F23Q 2/00 |
| 52-117197 | 1/1970 | Japan . | |
| 56-32749 | 6/1978 | Japan . | |
| 54-44176 | of 1979 | Japan . | |
| 62-180252 | 11/1987 | Japan | F23Q 2/28 |
| 505343 | 5/1971 | Switzerland | F23Q 2/02 |
| 1550484 | 8/1979 | United Kingdom | F23Q 3/01 |
| 1594556 | 7/1981 | United Kingdom | F23Q 2/34 |
| 2072820 | 10/1981 | United Kingdom | F23Q 2/16 |
| WO88/06699 | 9/1988 | WIPO | F23Q 2/32 |
| WO90/00704 | 1/1990 | WIPO | F23Q 2/16 |
| WO92/05391 | 4/1992 | WIPO | F23Q 2/16 |
| WO92/08931 | 5/1992 | WIPO | F23Q 2/28 |

SELECTIVELY ACTUATABLE LIGHTER

CROSS-REFERENCE TO RELATED APPLICATIONS

This is a continuation of application Ser. No. 07/723,989, filed Jul. 1, 1991, now U.S. Pat. No. 5,456,598; which is a continuation-in-part of U.S. patent application Ser. No. 07/609,668 filed on Nov. 6, 1990, now abandoned, entitled "Selectively Actuatable Lighter", which is a continuation of Ser. No. 07/239,734 filed on Sept. 2, 1988, entitled "Selectively Actuatable Lighter", which issued on Mar. 26, 1991 as U.S. Pat. No. 5,002,482; each of these two patent applications is incorporated herein by reference.

TECHNICAL FIELD

This invention relates generally to lighters which consume fuel such as, for example, butane which is stored in a reservoir in a liquid state, then passed through a valve means and finally ignited by a spark or other similar means. More particularly, the invention relates to a disposable butane cigarette lighter having a feature which interferes with depression of a valve actuator and in turn hinders expulsion of fuel from a valve nozzle (i.e., fuel nozzle) thereby rendering operation of the lighter by young children more difficult. Advantageously, this feature of the lighter may be deactivated by moving a latch to a non-interfering position, thus facilitating flame production.

DESCRIPTION OF THE PRIOR ART

Numerous lighters are known, some of them incorporating features which are designed to render operation of the lighter more difficult by certain users. Some of such features relate to mechanisms which are designed to prevent ignition of a fuel source unless the lighter is properly oriented, mechanisms which are designed to automatically turn off a fuel source supply valve, and tamper protection arrangements.

More recently, attention has been directed toward preventing ready actuation of such lighters by persons normally not able to appreciate the potential danger of the flame. Individuals normally contemplated in these efforts are young children, mostly in the age category of five years or younger.

U.S. Pat. No. 4,784,601 to Nitta relates to a gas lighter having an L-shaped slidable stopper which is positionable to prevent descent of a gas lever which centrols fuel flow. The lighter is rendered operable by moving the stopper outward so that its vertical leg is displaced from the top surface of the lighter housing. The L-shaped slidable stopper must be manually moved into its locking position each time it is desired to lock the lighter.

U.S. Pat. No. 4,784,602 to Nitta relates to a gas lighter having an L-shaped slidable stopper which is positionable to prevent descent of a gas lever which controls fuel flow. The lighter is rendered operable by moving the stopper inward so that its vertical pin engages a hole in the surface of the lighter housing. The L-shaped slidable stopper must be manually moved into its locking position each time it is desired to lock the lighter.

U.S. Pat. No. 4,786,248 to Nitta relates to a piezoelectric lighter equipped with a thumb-latch slidably fitted within a lighter casing. The thumb latch is manually slidable into and out of a position which interferes with depression of a thumb-pusher. The lighter is rendered operable by manually sliding the thumb-latch to an unlocked position. After operation of the lighter a user must manually slide the thumb-latch to its locked position in order to lock the lighter.

U.S. Pat. No. 4,904,180 to Nitta relates to a piezoelectric lighter equipped with a lock means which automatically returns to a locked position after use of the lighter. The lock means includes a stopper and a leaf-spring which keeps the stopper urged toward the windshield. The lighter may only be operated after the stopper is drawn backwards, away from the windshield. The lighter cannot maintain the stopper in the drawn back position without the application of constant force by a user. That is, no means are provided to maintain the lighter unlocked.

U.S. Pat. No. 1,895,032 to Fisher relates to a lighter in which a manual control means is movable out of engagement with a shoulder portion of the lighter so as to. enable the manual control means to be depressed thereby causing the lighter to operate. The control means returns to its position in engagement with the shoulder portion after use of the lighter. The lighter cannot maintain the control means in its out of engagement position-without the application of constant force by a user.

U.S. Pat. No. 4,830,603 to Cirami relates to a cigarette lighter in which a locking mechanism is provided partially under a valve-actuating pushbutton and extends into a compartment appended to but distinct from a fuel compartment. The locking mechanism relocks itself after each depression of the pushbutton. In particular, one end of a stiffly flexible, spring steel wire is held firmly in place in the compartment. Another end of the spring steel wire forms a probe extending into a channel provided in the underside of the pushbutton. The spring steel wire, in a locked configuration, prevents depression of the pushbutton by engaging a low ceiling on the underside of the pushbutton. A portion of the spring steel wire in the form of a loop extending outward from the lighter is accessible by an operator and may be suitably moved by the operator thereby causing the probe to move within the channel in the underside of the pushbutton.

U.S. Pat. No. 4,832,596 to Morris, Sr. relates to a cigarette lighter having a stop member slidably mounted thereon for releasably engaging a gas valve actuating lever. In particular, a spring biased stop member is slidably mounted on a top portion of a conventional disposable cigarette lighter. The stop member is biased so as to place one of its ends under the lighter's gas valve actuating lever so as to prevent movement of the lever in a direction which may open the gas valve. The lever may be actuated once the stop member is pushed in a direction opposite to the biasing force of the spring so as to slide the end which is under the lighter's gas valve outward.

U.S. Pat. No. 4,717,335 to Loveless relates to a cigarette lighter in which rotation of a spark-producing wheel is limited. In particular, the spark-producing wheel may be rotated in one direction to deliver a spark toward a nozzle through which gaseous fuel is passed, thereby causing the fuel to ignite and operating the lighter. Rotation of the spark-producing wheel in the other direction may deliver a spark away from the nozzle. The spark-producing wheel has a pin-shaped structure attached thereto which serves to limit the rotation of the wheel to under 360° by contacting the housing structure. Thus, whether a spark indeed is produced depends upon the direction of attempted rotation and the position of the pin-shaped structure relative to the housing structure. In theory, once the lighter is operated and the fuel ignited, and the pin-shaped structure has traversed its entire path of travel, subsequent operation of the lighter is impeded since the pin-shaped structure comes into contact with the housing, preventing a spark from occurring in the vicinity of the fuel nozzle.

U.S. Pat. Nos. 4,028,043 and 4,049,370 each to Neyret relate to presale tamper protection mechanisms which. partially surround a spark-producing wheel, fuel nozzle or depressable valve actuation member of a lighter. These presale tamper protection mechanisms are attached to the lighter housing by frangible webs and are removed by a purchaser after sale of the lighter to expose the spark-producing wheel, fuel nozzle and/or depressable valve actuation member. However, such a presale tamper protection mechanism is of limited value once initially removed by a purchaser.

U.S. Pat. Nos. 3,547,566 to Tamarin and U.S. Pat. No. 3,899,286 to Lockwood et al. relate to lighters having orientation sensing mechanisms which hinder or prevent actuation of the lighter in an inverted position. Unfortunately, such mechanisms may not provide a sufficient degree of child resistancy to young children who tamper with the lighter since they merely hinder operation in prescribed orientations.

Many mechanisms which are designed to render operation of the lighter more difficult by certain users are unnecessarily complicated, present difficulty in their manufacture and exhibit a high likelihood of mechanical failure during use. Another disadvantage found in some devices is that the particular construction employed limits the shape and size of the lighter housing due to the requirement that the housing be large enough to accommodate Such mechanism(s). Further disadvantages relate to the relative ease which some mechanisms may be defeated and to the reliability of the mechanisms. For example, some mechanisms may be overridden or removed with relative ease. Additionally, some devices are not equally adaptable for use by both right-handed and left-handed users, and some include inconveniently shaped levers or knobs which need to be actuated by the user in order to operate the lighter. Similarly, some devices which may indeed be equally adaptable to both right-handed and left-handed users employ a mechanism which is actuated differently and/or moved to different positions depending on whether the user is right-handed or left-handed. Furthermore, some of these devices require repositioning of the lighter in an operator's hand after actuation of the mechanism and before the lighter is operated to produce a flame. For example, some lighters include an actuatable mechanism-located sufficiently far from a valve actuation means, or on another side of the lighter than the valve actuation means, so as to result in awkward operation of the lighter.

Although it is known to prevent or hinder presale actuation of a depressable valve actuation member or actuation of a lighter in a specified orientation, none of the above-described lighters provides an efficiently manufacturable, relatively small, reliable mechanism for preventing actuation of the depressable valve actuation member and equally adaptable for use by both right-handed and left-handed users and which is similarly actuated by both right-handed and left-handed users.

As will be appreciated, development of a "child-proof" lighter per se may not be viable. At best, it can be reasonably sought to create a lighter having features which enhance its child-resistant capability, but how "child-resistant" a lighter will be will depend upon related factors and circumstances. Nevertheless, any lighter having features which enhance its child-resistant capability will have limitations with respect to young children, and no such lighter should provide parents or adults with a false sense of security so that they may become less cautious in their handling of the lighter or permit ready access to the lighter by young children. Further, such lighters should not be made so difficult to light as to cause adults to use alternative forms of lighting, i.e., matches, which are generally considered to be potentially more dangerous.

The present invention is directed toward a flame producing lighter which is selectively actuatable in such a manner as to provide a substantial degree of difficulty for young children—mostly five years or younger—to actuate the lighter and produce a flame, while being user friendly and capable of actuation by adults.

SUMMARY OF THE INVENTION

This invention relates to a selectively actuatable flame producing lighter having latch means such as a latch mechanism which is normally in a latched position and which is movable to an unlatched or non-interfering position in which the lighter may be operated. Advantageously, the latch mechanism may be operated with the same finger a user employs to depress a valve actuation lever, without requiring repositioning of the lighter in a user's hand. The lighter is adapted for use by right-handed as well as left-handed users with the same relative ease. The lighter is preferably similarly actuated by both right-handed and left-handed users, without detracting from the effectiveness of the lighter's child-resistant capability. That is, the latch mechanism is preferably movable along only a single path from its latched position to its unlatched position, whether operated by right-handed or left-handed users.

One particular embodiment of the invention relates to a flame producing lighter which comprises a housing defining reservoir for containing a combustible gaseous medium such as fuel under pressure; valve means arranged for selective actuation between a normally closed position which prevents exit of the gaseous medium from the reservoir, and an open position which permits exit of gaseous medium from the reservoir through the valve means; means for selectively producing sparks at a location proximate the gaseous medium exit opening of the valve means thereby selectively causing ignition of the gaseous medium; means normally positioned for preventing actuation of the valve means to the open position, the valve actuation prevention means being capable of generally vertical movement in the lighter and being movable out of the normal position into a second position only by application of an external force; means for selectively moving the valve actuation prevention means to the second position whereby actuation of the valve means to the open position is permitted thereby selectively permitting exit of the combustible gaseous medium from the valve means and ignition of the gaseous medium by sparks produced by the spark producing means, wherein the valve actuation prevention means automatically returns to the normal position after actuation of the lighter. The lighter preferably includes means to retain the valve actuation prevention means in the second position, thus retaining the lighter in an unlatched configuration. Additionally, the valve actuation prevention means of the lighter is preferably constrained to move along only a single path from its normal, or latched, position to the second, or unlatched, position.

In this embodiment, the valve means is preferably actuated to the open position by actuator means and the means for preventing actuation of the valve means to the open position comprises means for preventing pivotal movement of the actuator means by interference with the movement thereof, the valve actuation interference means being selectively movable to a position out of interference with the valve actuator means. The valve actuation interference means is normally retained in a valve actuation interference position, the movement thereof to the position out of interference with the valve actuator means is resiliently provided. Advantageously, the resilient movement of the valve actuation interference means causes the valve actuation interference means to return to its position beneath the valve actuator once the valve actuator is released, thus preventing the valve nozzle from opening.

The valve actuation interference means may take on a variety of forms such as a latch and may be movable in a variety of directions. Such movement is generally first in one direction, then in another direction. Alternatively, such movement may be in three or more directions, such as any combination of cross-wise, inward and upward movements. For example, the latch may be movable first inward and then upward into a cavity in the valve actuator until the valve actuator is depressed, whereby fuel exits the valve and the latch moves back under the valve actuator when the valve actuator is released.

The spark producing means of the lighter preferably includes flint material and a rotatable spark producing wheel which has a toothed surface positioned and arranged to selectively frictionally contact the flint material. Alternatively, the means for selectively producing sparks may be an electric spark-producing means, such as a piezo-electric spark-producing means.

Another embodiment of the invention relates to a flame producing lighter resistant to unauthorized use and normally maintained in a latched configuration comprising a housing; fuel supply means for supplying fuel to be ignited; ignition means for igniting the fuel; valve means for controlling the flow of the fuel; a valve actuator which normally prevents the flow of the fuel when in a first position and is depressable to a second position which permits actuation of the fuel supply means thereby permitting fuel to flow out from the fuel supply means; and a latch having at least a portion normally positioned between at least a portion of the valve actuator and at least a portion of the housing, the latch portion normally preventing depression of the depressable valve actuator and. normally maintaining the lighter in the latched configuration.

In this embodiment, inward movement of the latch enables a tip portion of the latch to become aligned with a cavity in the actuator, the cavity being sufficient in size to accommodate the tip portion so as to eventually enable the valve actuator to be depressed. The tip portion may comprise one or more tip portions. In one embodiment, the tip portion includes two tip portions normally separated by a gap. Cross-wise motion of the latch causes the two tip portions to become approximately adjacent to each other. In this embodiment, only after such cross-wise motion is the cavity capable of accommodating the tip portion so as to enable the valve actuator to be depressed.

Such inward movement of the latch is followed by upward movement which causes the aligned tip portion of the latch to enter the cavity and places the lighter in an unlatched configuration in which the valve actuator is capable of being depressed, thereby permitting fuel to flow, the unlatched configuration being resiliently maintained by forces exerted among the latch, the valve actuator and the housing.

Another embodiment of the lighter employs actuator means having a first interfering portion, and means for preventing pivotal movement of the actuator means by interference with its movement, such prevention means having a finger actuatable portion and a second interfering portion, the first and second interfering portions being normally in alignment with each other thereby preventing pivotal movement of the actuator means, the finger actuatable portion being selectively movable so as to move the second interfering portion out of alignment with the first interfering portion, the second interfering portion being normally retained in a valve actuation interference position, the movement thereof to a position out of interference with the valve actuator means being resiliently provided so as to return the second interfering portion to its position in interference with the valve actuator when the valve actuator is released, thus preventing the valve nozzle from opening.

In this embodiment, the movement of the finger actuatable portion which causes the second interfering portion to move out of alignment with the first interfering portion is constrained to movement in a single path. The movement of such finger actuatable portion comprises movement first in an inward direction and then movement in an upward direction. Such a lighter preferably includes means for retaining the second interfering portion out of alignment with the first interfering portion.

Another embodiment of the invention relates to a fuel cut-off mechanism for use in combination with a lighter which comprises means for normally preventing actuation of a fuel supply; means for selectively permitting actuation of the fuel supply including a depressible valve actuator which upon depression actuates the fuel supply thereby permitting fuel to flow out from the fuel supply; and a latch which normally interferes with depression of the depressible valve actuator, at least a portion of the latch being normally positioned between at least a portion of the valve actuator and at least a portion of a main body housing of the lighter so as to normally interfere with depression of the valve actuator, the latch being arranged such that inward movement of the latch provides a void between at least a portion of the valve actuator and at least a portion of the latch, the void being sufficient in size to enable upward movement of the latch, subsequent to the inward movement, into an unlatched position in which the latch is resiliently maintained, thereby placing the lighter in an unlatched configuration wherein the valve actuator is capable of being depressed thereby permitting fuel to flow.

Such a fuel cut-off mechanism preferably includes means for constraining the movement of the latch to a single path equally suitable for both right-handed and left-handed users, and/or means for retaining the lighter in the unlatched configuration.

Another embodiment of the invention relates to a flame developing lighter comprising a housing; fuel supply means for supplying fuel to be ignited; ignition means for igniting the fuel; valve means for selectively permitting. flow of the fuel; and control means for preventing the combination of production of fuel flow and spark generation so as to prevent production of a flame and for permitting substantially simultaneous production of fuel flow and spark generation to produce a flame.

The control means of this embodiment preferably includes a valve actuator which normally prevents escape of the fuel from the fuel supply means when in a first position and is depressable to a second position which permits actuation of the fuel supply means thereby permitting fuel to flow out from the fuel supply means, the valve actuator having a cavity formed therein; and a latch having an interfering portion which is normally in an interfering position thereby preventing depression of the depressable valve actuator. Inward movement of the latch causes the interfering portion to move to a non-interfering position in which the valve actuator may be depressed, and further movement in another direction, subsequent to the inward movement, of the latch into another non-interfering position, the another non-interfering position being resiliently maintained, provides the lighter in an unlatched configuration in which the valve actuator is capable of being depressed, thereby permitting fuel to flow. Such another direction may be, for example, upward, downward, or cross-wise.

Operation of the lighter requires a certain amount of dexterity and the application of concentrated forces as well as the application of a plurality of forces in multiple directions and in a specified sequence. Additionally, operation of the lighter requires a certain level of cognitive ability.

Furthermore, the lighter of the present invention is a passive latching lighter. Advantageously, the lighter automatically returns to its latched configuration once the depressed valve actuator is released. Thus, the lighter is maintained in an at-rest or default configuration which is latched thereby preventing the flow of fuel and the production of a flame.

Advantageously, the lighter is adapted for use by right-handed as well as left-handed users with the same relative ease, and is similarly actuated by both right-handed and left-handed users. Furthermore, the user may operate the latch mechanism with the same finger as used to depress the valve actuator without requiring the user to reposition the lighter in the user's hand.

BRIEF DESCRIPTION OF THE DRAWINGS

These and other objects, features, and advantages of the present invention will become more readily apparent from the following detailed description of the invention in which like elements are labelled similarly and in which FIGS. 1–19 depict the lighter of the present invention with one embodiment of a valve actuator and latch mechanism, and FIGS. 20–28 depict the lighter of the present invention with an alternative embodiment of the valve actuator and latch mechanism, and in which:

FIG. 1 is a perspective view of a preferred embodiment of a selectively actuatable lighter of the present invention in a latched configuration;

FIG. 3 is a partial cross-sectional view of the lighter of FIGS. 1 and 2 depicting the latch mechanism in a latched configuration;

FIG. 4 is an exploded view of the valve actuator and latch mechanism depicted in. FIGS. 1–3;

FIG. 5 is a side view of the latch mechanism depicted in FIG. 4;

FIG. 6 is a bottom view of the valve actuator depicted in FIG. 4;

FIG. 7 is a top view of the valve actuator depicted in FIG. 4;

FIG. 8 is a schematic diagram depicting a piezoelectric lighter apparatus in which the present invention may be employed and having an optional switch depicted in the open position and a latching means depicted in the latched position to prevent the production of sparks and the flow of fuel;

FIG. 9 is a schematic diagram depicting the piezoelectric lighter of FIG. 8 with the switch depicted in the closed position and the latching means depicted in the unlatched position and depicting a flame;

FIG. 10 is a perspective view of a preferred embodiment of the lighter in a latched configuration in which the latch mechanism is at its at-rest latched position thereby preventing depression of the valve actuator so as to prevent a valve from being opened and prevent gas from being released through a fuel nozzle;

FIG. 11 is a perspective view of the lighter of FIG. 10 in a partially unlatched configuration in which the latch mechanism has been moved from its at-rest latched position inward;

FIG. 12 is a perspective view of the lighter of FIG. 11 in an unlatched configuration in which the position of the latch mechanism is moved from its at-rest latched position inward and upward thereby enabling the valve actuator to be depressed so as to allow a valve to be opened and to release gas through a valve nozzle;

FIG. 13 is a perspective view of the lighter of FIG. 12 with the valve actuator in a depressed position and the valve open and depicting a flame;

FIG. 14 is a partial cross-sectional view of a preferred embodiment of the lighter depicting the lighter in an unlatched but not depressed configuration;

FIG. 15 is a partial cross-sectional view of a preferred embodiment of the lighter depicting the lighter in an unlatched and depressed configuration;

FIG. 16 is a partial cross-sectional view of the preferred embodiment of the lighter in its latched position thereby preventing depression and actuation of the valve actuator;

FIG. 17 is a partial cross-sectional view of the lighter of FIG. 16 in a partially unlatched position and the valve actuator not depressed;

FIG. 18 is a partial cross-sectional view of the lighter of FIG. 17 in its fully unlatched position and the valve actuator not depressed and the lighter ready for actuation;

FIG. 19 is partial cross-sectional view of the lighter of FIG. 18 in its unlatched position and the valve actuator fully depressed so as to permit the flow of fuel;

FIG. 20 is an exploded view of an alternative embodiment of a valve actuator and latch mechanism;

FIG. 21 is a frontal view of the latch mechanism depicted in FIG. 20 in its latched configuration;

FIG. 22 is a frontal view of the latch mechanism depicted in FIG. 20 in its unlatched or partially unlatched configuration;

FIG. 23 is a perspective view of the latch mechanism depicted in FIG. 20 in its latched configuration;

FIG. 24 is a perspective view of an alternative embodiment of the lighter in a latched configuration in which the latch mechanism is at its at-rest latched position thereby preventing depression of the valve actuator so as to prevent a valve from being opened and prevent gas from being released through a fuel nozzle;

FIG. 25 is a perspective view of the lighter of FIG. 24 in a partially unlatched configuration in which the latch mechanism has been moved from its at-rest latched position cross-wise and inward;

FIG. 26 is a perspective view of the lighter of FIG. 25 in an unlatched configuration in which the position of the latch mechanism is moved from its at-rest latched position cross-wise, inward and upward thereby enabling the valve actuator to be depressed so as to allow a valve to be opened and to release gas through a valve nozzle;

FIG. 27 is a perspective view of the lighter of FIG. 26 with the valve actuator in a depressed position and the valve open and depicting a flame; and FIG. 28 is a perspective view of the lighter of FIG. 26 in more detail.

DETAILED DESCRIPTION OF THE PREFERRED EMBODIMENT

Figure 1:
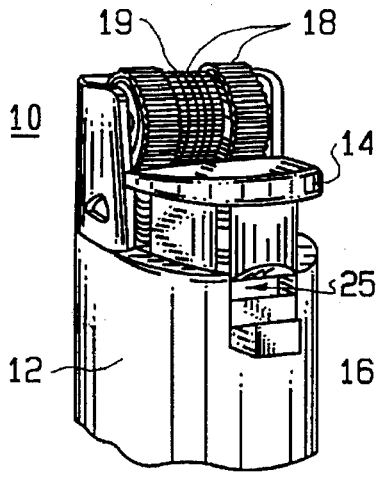
Figure 2A:
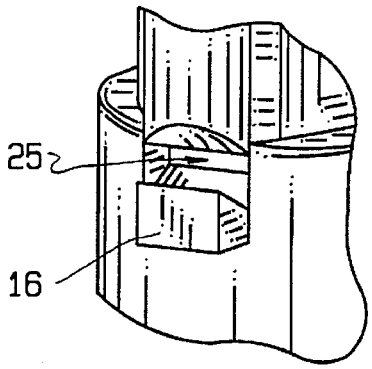
FIGS. 2A and 2B are perspective views from a different angle of the lighter depicted in FIG. 1 and further depicting a latch mechanism in greater detail.
Figure 2B:
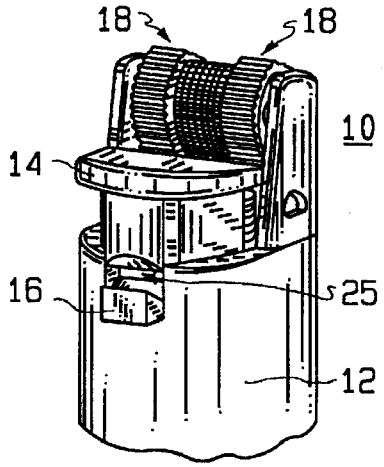

Referring initially to FIGS. 1 and 2, there is depicted, in a default or at-rest configuration, the lighter 10 of the present invention comprising a main body portion 12, a depressable valve actuator 14, latch means 16 such as a latch mechanism, and a spark-producing wheel assembly 18 which includes a toothed surface 19. Advantageously, the default configuration is also a latched configuration in which valve actuator 14 cannot be depressed due to the interference presented by latch means 16. Depression of valve actuator 14 permits fuel to flow through a fuel nozzle (not shown) and to be ignited by sparks produced by toothed surface 19 of spark-producing wheel assembly 18 frictionally engaging a flint (not shown). Advantageously, unless latch means 16 is positioned away from its depicted at-rest or default position and into a non-interfering position such as into a cavity formed in the underside (not shown) of valve actuator 14, any attempted depression of valve actuator 14 will not result in the flow of fuel and the lighter will be inoperable. The position of latch means 16 as shown in FIGS. 1–3 may best be characterized as a "default position" under normal conditions.

As will be appreciated, a variety of configurations, shapes and relative positioning exists for the valve actuator and the latch means in which the latch means is movable, with respect to the valve actuator, between an interfering or latched position and a non-interfering or unlatched position. The invention will be described in terms of a preferred embodiment in which an illustrative latch normally interferes with depression of the valve actuator when in a latched position, and is movable to an unlatched position in which the valve actuator may be depressed. Preferably, the latch is moved from its latched position to its unlatched position along a single path, which is equally suitable for right-handed as well as left-handed users. Such movement is illustratively in an inward direction followed by an upward direction. Alternatively, such movement may be in an inward direction followed by a downward direction, or in an inward direction followed by a cross-wise direction, or in a cross-wise direction followed by a downward direction or in a cross-wise direction followed by an upward direction. Additionally, the reverse of any of these combinations may be employed. For example, the reverse of the inward and then upward movement comprises an upward and then inward movement. As will be appreciated, for ease of understanding, such inward motion of the latch is deemed to include any inward motion of any portion of the latch.

A user typically holds the main body portion of the lighter in his hand, rotates with his thumb the spark-producing wheel in a direction toward the depressable surface of the valve actuator to produce a spark, while depressing the valve actuator to allow fuel to pass through the fuel, or valve, nozzle. The spark produced by the wheel ignites the fuel. This is a relatively conventional structure for most lighters, including disposable lighters.

Figure 3:
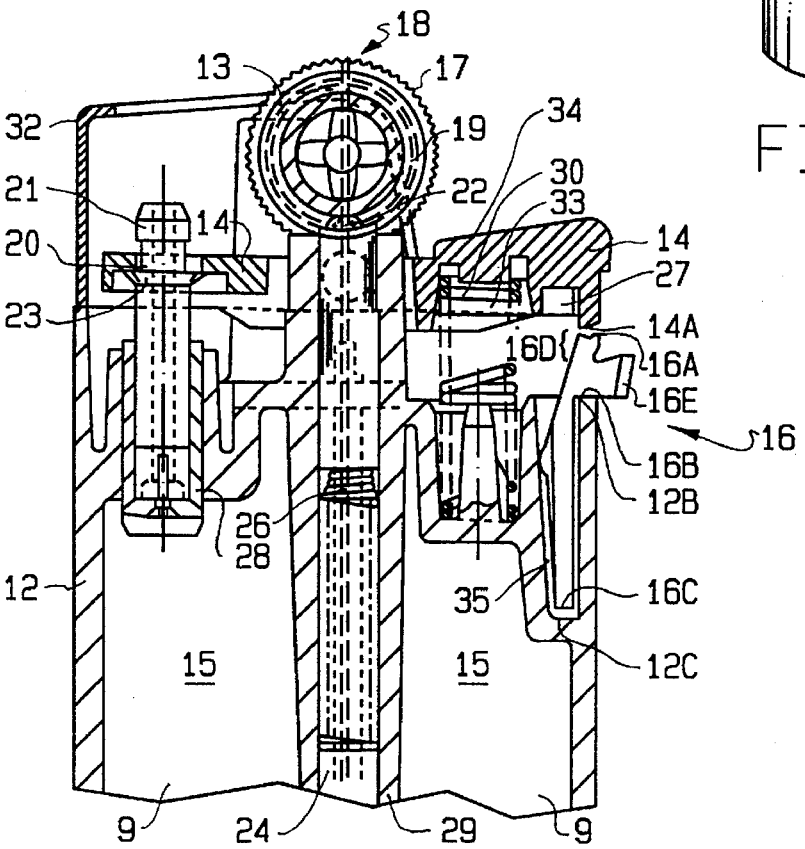

Referring now to FIG. 3, there is depicted a cross-section of the lighter of FIGS. 1 and 2 in a latched configuration. More particularly, valve actuator 14 is pivotally mounted between side wall portions 13 which comprise extensions of the side walls of body portion 12. Valve actuator 14 is attached to hollow fuel nozzle 20 slidably supported within a valve housing 28. Hollow fuel nozzle 20 is held within a bore in valve actuator 14 by flanges 21, 23 having sufficient diameter to prevent slippage of nozzle 20 through the bore in valve actuator 14. A compressed spring 30 resides partially within a recess 33 formed in valve actuator 14 and causes fuel nozzle 20 to be urged downward into valve housing 28 and body portion 12. In particular, compressed spring 30 causes valve actuator 14 to apply force to flange 23, thereby urging nozzle 20 downward into valve housing 28 and body portion 12 and preventing the flow of fuel through nozzle 20. In such an embodiment, valve actuator 14 is employed to lift nozzle 20 by the application of force to flange 21 in order to expel fuel. A valve assembly (not fully shown) is located near the recessed end of nozzle 20 and permits fuel to flow through nozzle 20 only when valve. actuator 14 is depressed and nozzle 20 lifted.

Lighter 10 further comprises a sparking flint 22 mounted within a bore 24 defined by flint and spring housing 29 in main body 12. Flint 22 is urged toward toothed surface 19 of wheel assembly 18 by spring 26. Spark-producing wheel assembly 18, which includes toothed surface 19 which is preferably suitably hardened and against which flint 22 is urged, is mounted for rotation between side wall extension portions 13 in a conventional manner. Toothed surface 19 includes suitable indentations which define teeth such that when spark-producing wheel assembly 18 is rotated toothed surface 19 cuts against flint 22 causing the generation of ignition sparks. Additionally, spark-producing wheel assembly 18 includes suitable indentations 17 which facilitate rotation of spark-producing wheel assembly 18 by an operator's finger.

Main body 12 defines an internal chamber 15 which is filled with a fuel 9 such as butane fuel capable of vaporizing in a conventional manner to produce a gaseous medium which passes through fuel nozzle 20 under the control of a valve. Main body 12 is constructed from any suitable structural material and is preferably constructed from a plastic material. A shield 32, preferably constructed from metal, is provided and functions as a wind guard around the flame thereby assisting in the ignition of the fuel.

As depicted in FIGS. 1 and 2 a notched opening 25 is provided in body portion 12 to accommodate valve actuator 14 and latch mechanism 16 and, in particular, vertical movement of valve actuator 14 and latch mechanism 16. As will be appreciated, FIGS. 1–3 depict the lighter and, more specifically, the latch mechanism, of the present invention in a latched configuration, i.e., a default configuration. In this latched configuration, an interfering portion 16A of latch mechanism 16 is positioned beneath an interfering portion 14A of valve actuator 14 and prevents depression of valve actuator 14, thereby preventing operation of the lighter.

Referring again to FIG. 3, latch mechanism 16 is depicted in its latched configuration in which interfering portion 16A of latch 16 is positioned and configured so as to interfere with and prevent depression of valve actuator 14. More specifically, interfering portion 14A of valve actuator 14 contacts interfering portion 16A of latch 16 upon attempted depression of valve actuator 14, thus preventing the escape of fuel from fuel nozzle 20 and also preventing operation of the lighter. In its latched configuration, latch 16 is prevented from any downward travel in channel 35 by the contact between interfering portion 16B of latch 16 and interfering portion 12B of main body 12. Interfering portion 12B defines part of notch 25. Alternatively, any such downward travel of valve actuator 14 may be prevented by portion 16C of latch 16 contacting portion 12C of body 12. As will be discussed in conjunction with FIGS. 4 and 6, the underside at valve actuator 14 is provided with a cavity 27 suitably shaped for receiving a portion of latch 16 including a tip portion 16D which in turn includes interfering portion 16A.

Figure 4:
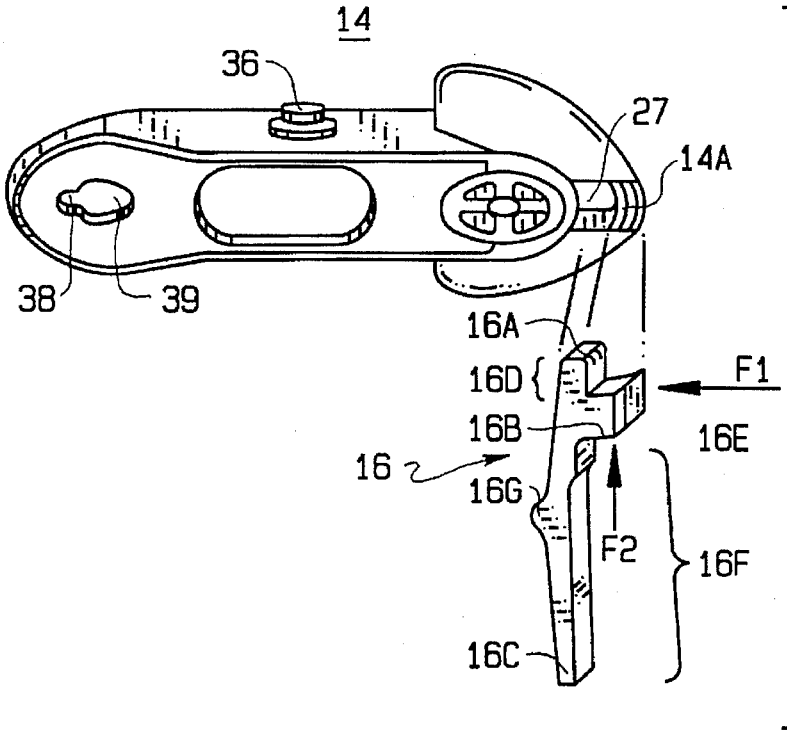

Referring now to FIG. 4, there is depicted valve actuator 14 and latch 16 in greater detail. Valve actuator 14 comprises a finger depressable surface 34 (not shown), extensions 36, a bore 38, a bore 39, and cavity 27. Preferably, cavity 27 is shaped so as to receive tip portion 16D of latch 16, including interfering portion 16A. A user desiring to actuate the lighter must first force tip portion 16D into cavity 27 by initially applying a component F1 of force to a finger actuatable portion 16E of latch 16 so as to force tip portion 16D inward and into alignment with cavity 27, and then applying a component F2 of force to finger actuatable portion 16E so as to force tip portion 16D upward into cavity 27. The user may then depress finger depressable surface 34 (not seen in FIG. 4).

Extensions 36 are provided to matingly engage with bores in side wall portions 13 of body portion 12 to provide pivotal movement of the valve actuator about extensions 36. Bore 38 is adapted for receiving and grasping a portion of fuel nozzle 20 between flanges 21 and 23. In the latched or close configuration depicted in FIGS. 1–3, an upper surface of interfering portion 16A of latch 16 abuts a lower surface of interfering portion 14A of valve actuator 14, and a lower surface of interfering portion 16B of latch 16 abuts portion 12C of body 12 defined or formed by notch 25, thereby preventing depression of valve actuator 14. Alternatively, a small gap may be provided between the upper surface of interfering portion 16A of latch 16 and a lower surface of interfering portion 14A of valve actuator 14.

Figure 5:
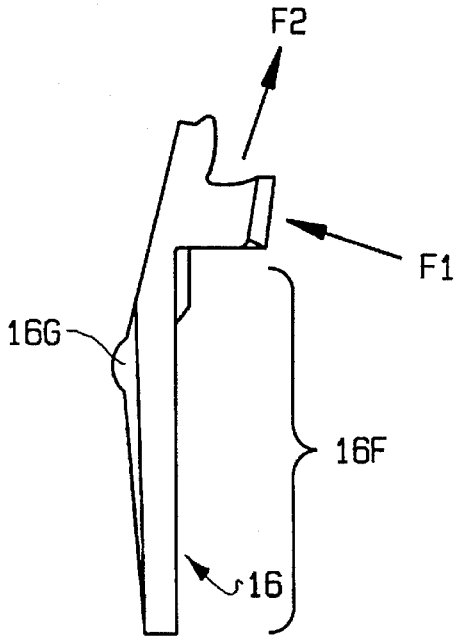

Referring now to FIGS. 4 and 5, latch 16 is preferably provided with an elongated portion 16F which facilitates stabilization of latch 16 within channel 35 formed in body portion 12 and assures proper positioning and retention of latch 16 in notched opening 25 especially when the latch is moved. Elongated portion 16F is dimensioned and structured to engage an inner wall or a structural member of the lighter housing defined by channel 35 when latch 16 is moved in a vertical direction. Finger actuatable portion 16E of latch 16 is employed-by a user to move the latch and, in particular, to move tip portion 16D inward and then upward so as to enter cavity 27 of actuator 14. Elongated portion 16F is preferably provided with a projecting portion 16G to aid in the stabilization, positioning and retention of latch 16 in channel 35.

Advantageously, such a configuration facilitates resilient movement of latch 16 and/or portions thereof. Additionally, such a configuration facilitates retention of the lighter and, in particular, latch 16, in an unlatched or non-interfering position or configuration once the latch is placed in such an unlatched position or configuration and until valve actuator 14 is depressed and released. Although latch 16 is depicted as having a relatively smooth surface on finger actuatable portion 16E, portion 16E, or parts thereof, may be provided with a ridged surface. Such a ridged surface provides frictional resistance with a user's finger to facilitate movement of finger actuatable portion 16E with respect to valve actuator 14.

Referring specifically to FIG. 5, there is illustrated a side view of latch 16. Latch 16 is preferably symmetrical. Latch 16 is sufficiently flexible in a first direction F1 inward so as to align tip portion 16D with cavity 27 even though elongated portion 16F is somewhat constrained in its ability to more inward.

It is desirable that the material from which latch 16 is constructed is relatively rigid material which is sufficiently resilient to permit movement of finger actuatable portion 16E inward so as to at least partially align tip portion 16D with cavity 27. Latch 16 is preferably constructed from any sufficiently resilient metal or elastomer, although a wide variety of other suitable materials having a sufficient degree of elastic memory may be employed.

Figure 6:
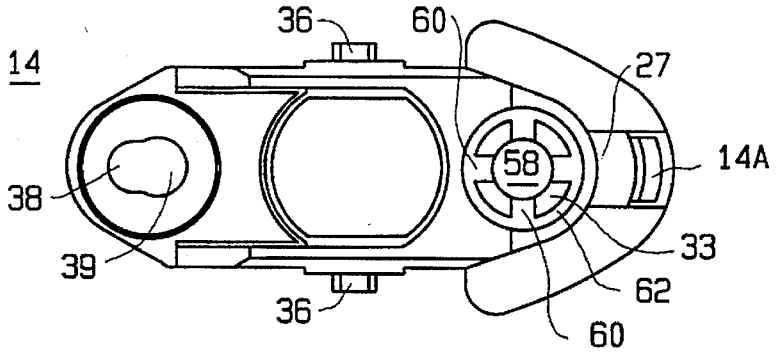
Figure 7:
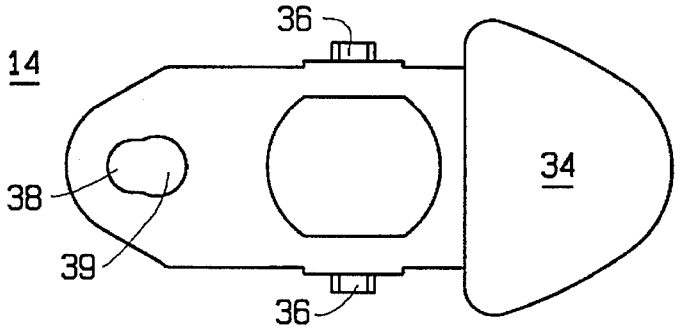

Referring now to FIGS. 6 and 7, there are depicted views of the underside (FIG. 6) and of the top side (FIG. 7) of valve actuator 14 of FIG. 4. Recess 33 is adapted to receive spring 30 as depicted in FIG. 3 and may take on a variety of forms such as a simple indentation or, alternatively, a bore partially into valve actuator 14 and having a center pin 58, extensions 60 and a chamfered edge 62. The fuel nozzle is maintained in bore 38 by fuel nozzle flanges 21 and 23 which have a diameter greater than that of bore 38 but less than that of bore 39. Cavity 27 is formed in the underside of valve actuator 14 as depicted in FIG. 6, and may take on any shape suitable to properly receive tip portion 16D of latch 16. Valve actuator 14 is Constructed from material having sufficient dimensional stability and rigidity to continuously over the life of the lighter assure proper relative positioning between interfering portion 14A of valve actuator 14 and interfering portion 16A of latch 16. Actuator 14 is preferably constructed from glass-filled polyetherimide. Other illustrative materials from which valve actuator 14 may be constructed are zinc, aluminum and other glass filled polymers such as polyethersulfone or the like, as well as combinations of these materials.

Figure 8:
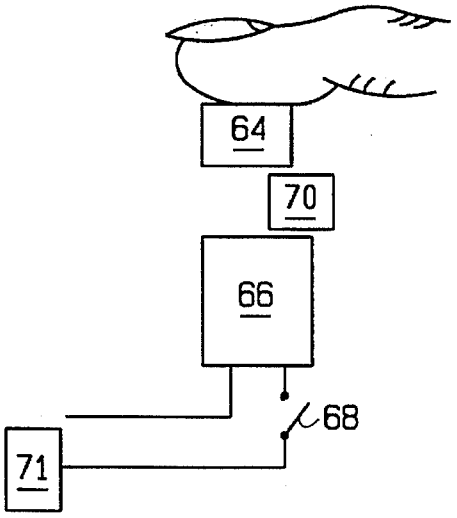

FIG. 8 schematically depicts a piezoelectric type lighter in which the present invention may be employed. The piezoelectric lighter comprises hammer and fuel release means 64, spark providing means 66, electrical cut-off switch 68, latching means 70 and valve means 71. The piezoelectric lighter operates in a conventional manner except for depression of hammer means 64 which is prevented by inclusion of latching means 70 operative on the fuel supply in accordance with the present invention. Illustratively, such latching means comprises a latch mechanism and a valve actuator which preferably prevent the flow of fuel as previously described, as well as preventing the production of sparks. In particular, latching means 70 may prevent the production of sparks by electrically and/or mechanically isolating an energy source from the spark producing means. Alternatively, the latching means may be arranged to selectively prevent only the flow of fuel or it may be arranged to selectively prevent the production of sparks. As depicted in FIG. 8, the lighter is in a latched configuration since latching means 70 is positioned so as to prevent actuation of hammer means 64. Additionally, switch 68 is depicted in an open, or off, position.

Figure 9:
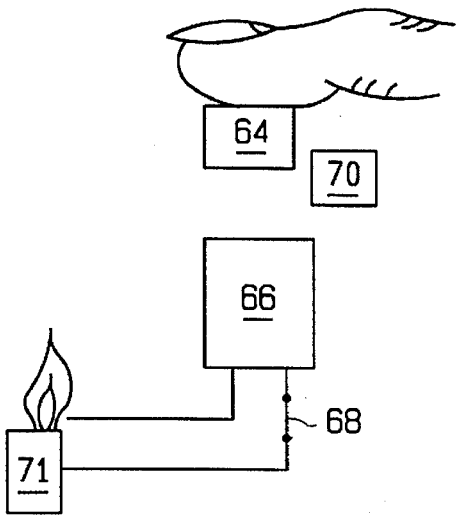

FIG. 9 schematically depicts the piezoelectric type lighter of FIG. 8 in an unlatched configuration. particular, latching means 70 is positioned so as to enable actuation of hammer means 64. Additionally, switch 68 is depicted in a closed, or on, position.

Figure 10:
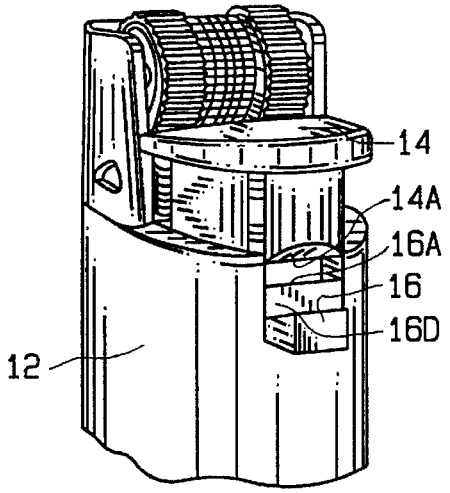
Figure 11:
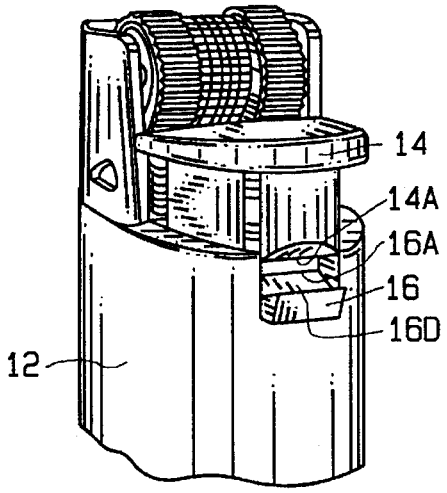
Figure 12:
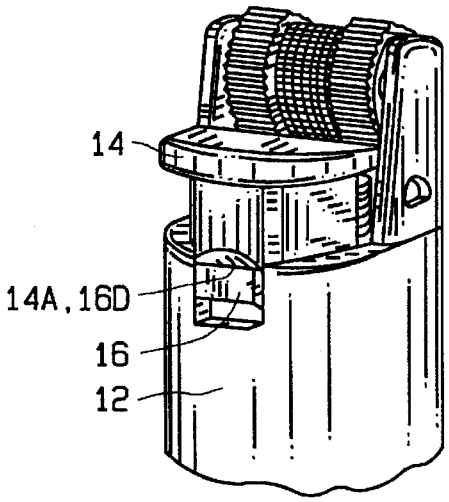
Figure 13:
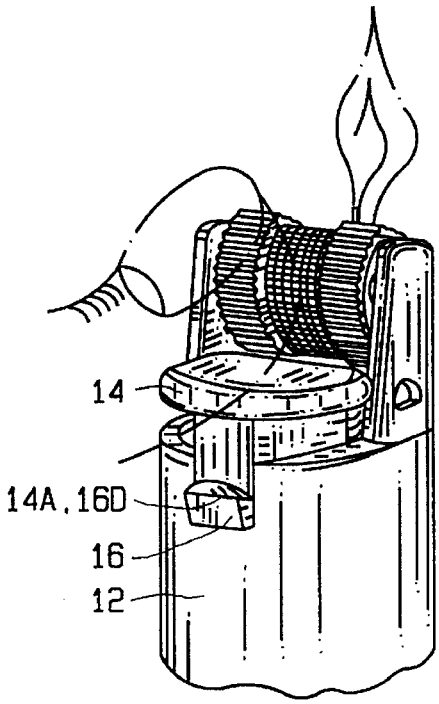

In operation of the present invention, and as depicted in FIGS. 10 and 11, a user must first move latch 16 in an inward direction so a to sufficiently displace interfering portion 16A of latch 16 out of interference with interfering portion 14A of actuator 14, and at least partially align tip portion 16D of latch 16 with cavity 27 (not shown) of actuator 14 so as to ultimately permit depression of valve actuator 14. However, in order to facilitate retention of latch 16 in such a displaced position, latch 16 is then displaced in an upward direction such that tip portion 16D of latch 16 engages cavity 27 of valve actuator 14 (see FIGS. 3 and 4). Such an unlatched configuration is depicted in FIG. 12. Depression of valve actuator 14 at this point combined with and preferably preceded by rotation of the spark-producing wheel assembly 18 will cause the lighter to operate, and will also cause latch 16 to travel downward in channel 35 (FIG. 3), as indicated in FIG. 13. In particular, the sparks thus produced will ignite the gaseous fuel which is permitted to be expelled from the fuel nozzle when valve actuator 14 lifts the nozzle thereby actuating the valve. The lifting action of valve actuator 14 in a vicinity near the nozzle partially relieves the pressurized condition in the fuel chamber thereby permitting the flow of fuel as a gaseous medium through the nozzle and the subsequent burning of such fuel. For ease of illustration, the gap between portions 14A and 16A has been exaggerated in the figures.

Thus, the presently preferred embodiment of the invention may be placed in an unlatched configuration from its default latched configuration by sufficiently displacing interfering portion 16A relative to interfering portion 14A. This may be accomplished by moving tip portion 16D into engagement with cavity 27 of actuator 14. Advantageously, the path defined by such movement is the same for right-handed and left-handed users, and each of such users may unlatch the lighter with the same relative ease. Thus, the lighter of the present invention enables every user, whether right-handed or left-handed, to actuate the lighter by suitably urging the latch mechanism out of interference with the valve actuator, and does not require separate paths or structures to accommodate right-handed and left-handed users.

More specifically, by providing a single path for latch mechanism 16 to follow as the lighter is reconfigured from the latched configuration to the unlatched configuration, which path does not favor either of right-handed or left-handed users more than the other, although both such users employ the same path, such users will feel equally comfortable in actuating the lighter without detracting from the effectiveness of the lighter's latch mechanism.

Figure 14:
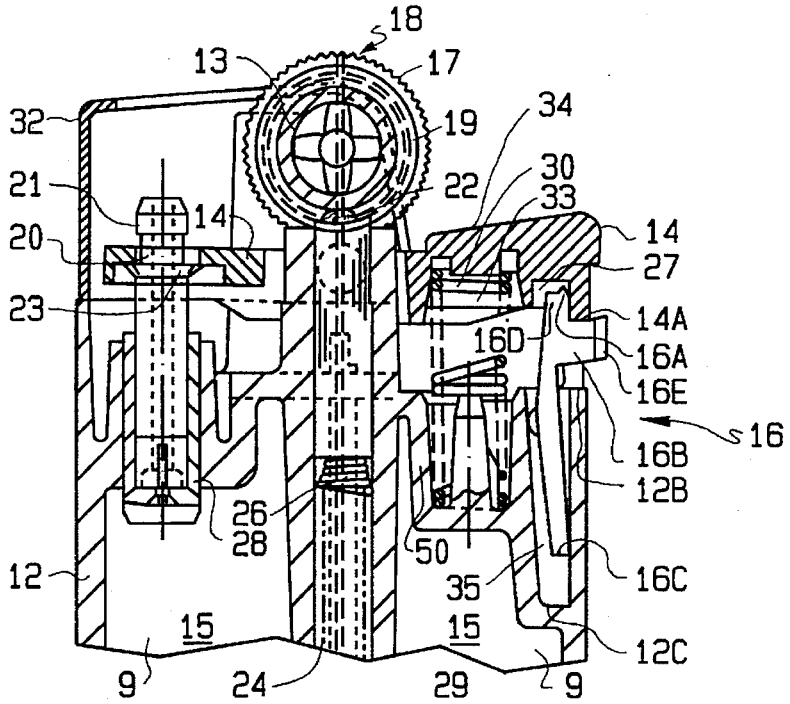

Referring to FIG. 14, there is depicted a partial cross-sectional view of the lighter of the present invention in an unlatched and undepressed, i.e., not actuated, configuration. As can be seen from FIG. 14 in conjunction with FIG. 3, tip portion 16D has been moved so as to engage cavity 27 of valve actuator 14. Advantageously, forces provided by valve actuator 14 and, in particular, by the part of actuator 14 defined by cavity 27, to latch 16 facilitate retention of the lighter and, in particular, latch 16, in an unlatched and undepressed position as depicted in FIG. 14. In other words, the lighter may be readied for actuation and flame production by applying suitable force to finger actuatable portion 16E to first move portion 16E in an inward direction and then in an upward direction so as to place tip portion 16D into engagement with cavity 27 of valve actuator 14.

Figure 15:
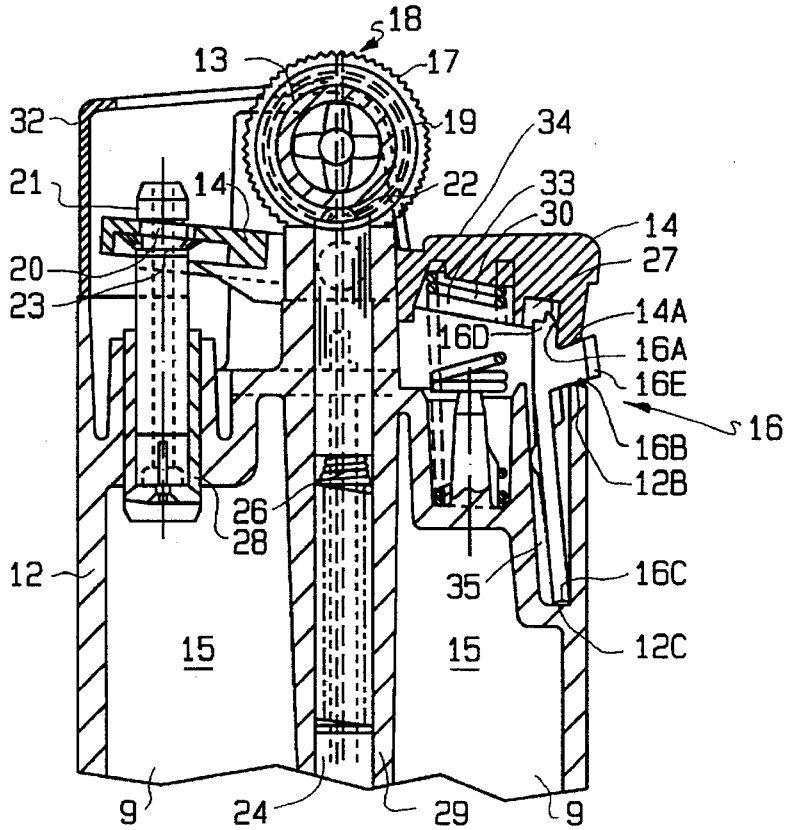

Referring now to FIG. 15, there is depicted a cross-section of the lighter of the present invention in a depressed and actuated configuration. As will be appreciated, movement of finger actuatable portion 16E of latch 16 inward and upward so as to place tip portion 16D into cavity 27 will permit unimpeded depression of the valve actuator as depicted in FIG. 15.

More specifically, such movement of latch 16 followed by depression of valve actuator 14 will cause compression of spring 30 and urging of fuel nozzle 20 upward and partially out of valve housing 28 and body portion 12. Such lifting of fuel nozzle 20 upward will permit fuel to flow from chamber 15 through the valve and out of nozzle 20 whereupon it will have been ignited by sparks produced by flint 22 and toothed surface 19 of spark-producing assembly wheel 18. Hollow fuel nozzle 20 is held within bore 38 (FIG. 4) in valve actuator 14 by flanges 21, 23 having sufficient diameter to assure proper movement of the nozzle within valve housing 28.

Figure 16:
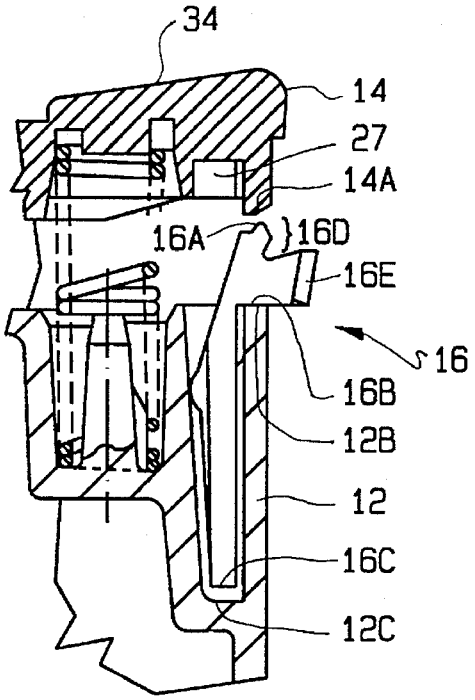

FIGS. 16–19 depict the sequence of operations required for the unlatching of the lighter by positioning tip portion 16D in cavity 27 of actuator 14. In particular, FIG. 16 depicts latch 16 and valve actuator 14 in the default or latched position. In this position, depression of valve actuator 14 by finger pressure on surface 34 is prevented by the contact between interfering portion 14A of valve actuator 14 and interfering portion 16A of latch 16. As depicted in FIG. 16, interfering portion 16A is positioned directly beneath interfering portion 14A of valve actuator 14 and latch 16 is prevented from any further downward movement since interfering portion 16B of latch 16 abuts interfering portion 12B of body 12.

Figure 17:
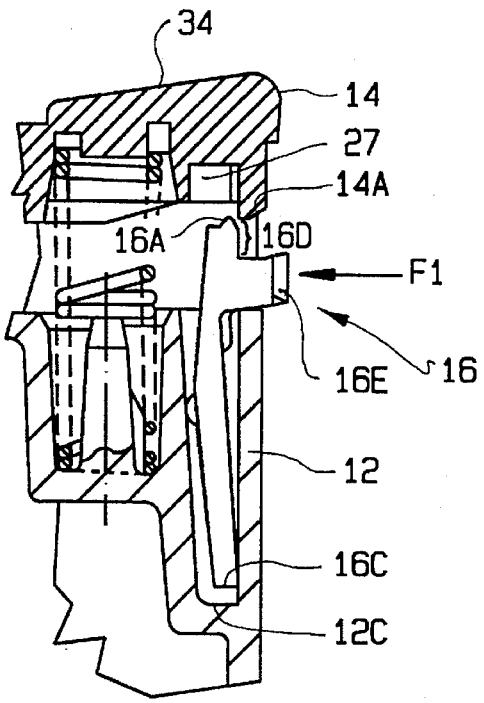

FIG. 17 depicts latch 16 in a partially unlatched position and valve actuator 14 in an undepressed position. Finger actuatable portion 16E and tip portion 16D along with interfering portion 16A of latch 16 have ben moved inward in a direction indicated by the arrow, providing alignment between tip portion 16D and cavity 27 of valve actuator 14. As depicted, latch 16 is under loading. Absent any holding pressure on finger actuatable portion 16E in the position depicted in FIG. 17, tip portion 16D and finger actuatable portion 16E will return to their at rest position as depicted in FIG. 16.

Figure 18:
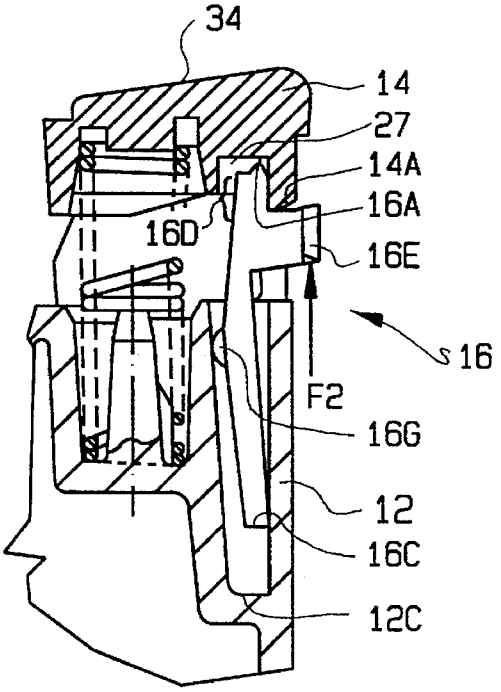

FIG. 18 depicts latch 16 and valve actuator 14 in an unlatched configuration ready for depression of valve actuator 14. Tip portion 16D of latch 16 has been moved upward in a direction indicated by the arrow into engagement with cavity 27 of valve actuator 14. Advantageously, due to, inter alia, the loading which latch 16 is under when tip portion 16D engages part of actuator 14 defined by cavity 27, removal of holding pressure from finger actuatable portion 16E once tip portion 16D has been engaged with, i.e., inserted into, cavity 27 will not result in tip portion 16D or finger actuatable portion 16E slipping toward their respective latched positions but will maintain the lighter in the unlatched configuration depicted in FIG. 18, until valve actuator 14 is depressed.

Figure 19:
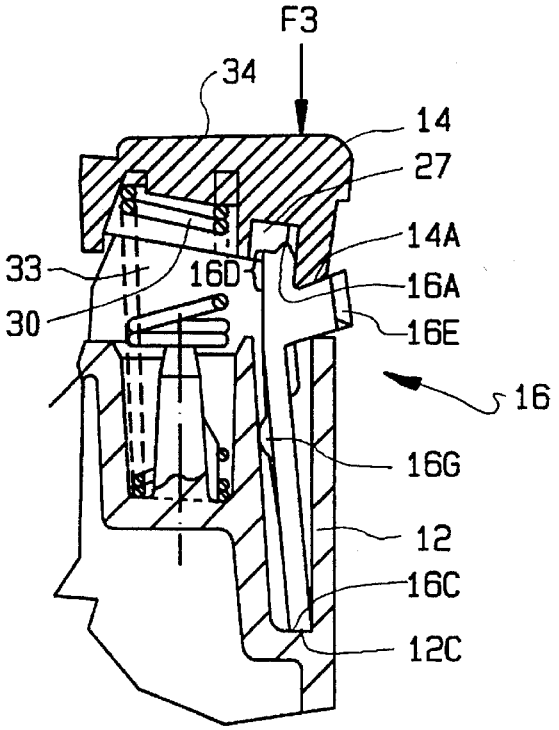

Application of finger pressure to the finger depressable surface of valve actuator 14 as depicted in FIG. 18 will yield the configuration depicted in FIG. 19 in which valve actuator 14 has been depressed thereby permitting fuel to flow through the valve and the fuel nozzle (not shown). In particular, depression of valve actuator 14 urges latch 16 downward toward its partially latched position. Provided that the spark-producing wheel assembly was actuated in combination with valve actuator 14 being depressed, the fuel flowing through the fuel nozzle will be ignited. Such fuel will continue to flow and burn as long as sufficient pressure is maintained on valve actuator 14.

Once pressure is removed from valve actuator 14, the valve actuator will move Upward due to the biasing force provided by spring 30, and the flame will be extinguished. Advantageously, as valve actuator 14 moves upward, latch 16 remains in the down position since frictional forces between latch 16 and actuator 14 are less than the forces required to lift the latch and overcome, for example, forces between latch 16 and portions of body 12 defined by channel 35. Once valve actuator 14 moves upward a sufficient amount, tip portion 16D and finger actuatable portion 16E move in a direction opposite that indicated by the arrow in FIG. 17, toward their at-rest position.

While FIGS. 1–19 depict the lighter of the present invention with one embodiment of a valve actuator and latch mechanism that operates by moving the latch mechanism inward (F1) and then upward (F2), FIGS. 20–28 depict the lighter of the present invention with an alternative embodiment of the valve actuator and latch mechanism that operates by moving the latch mechanism first cross-wise (F1), then inward (F2) and then upward (F3). This embodiment may also operate by moving the latch mechanism first inward, then cross-wise and then upward.

Figure 20:
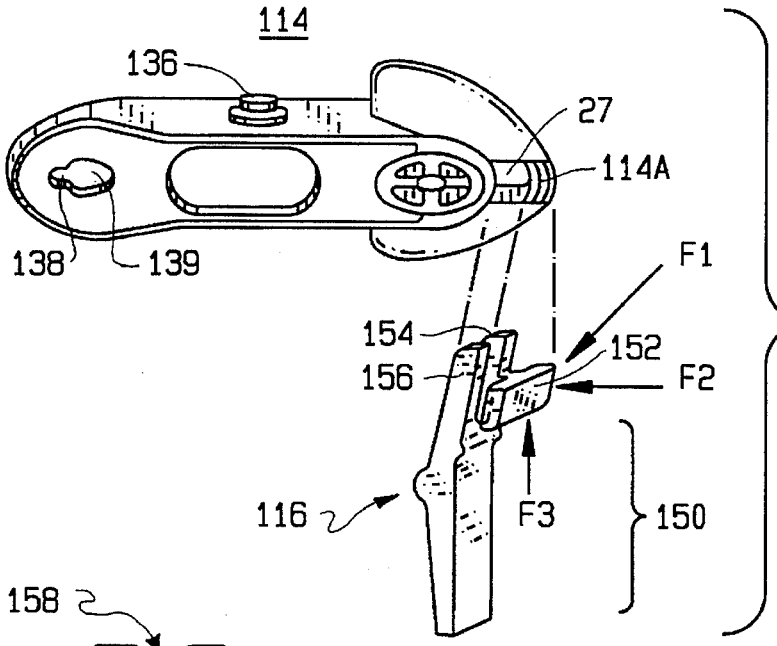
Figure 21:
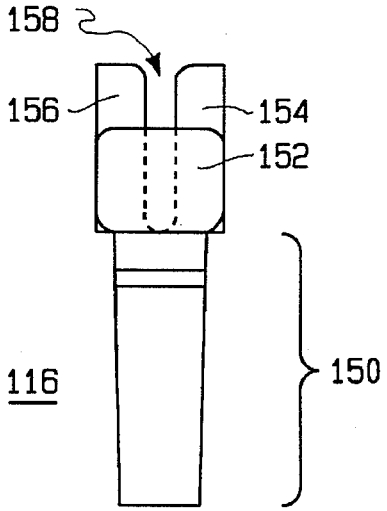
Figure 22:
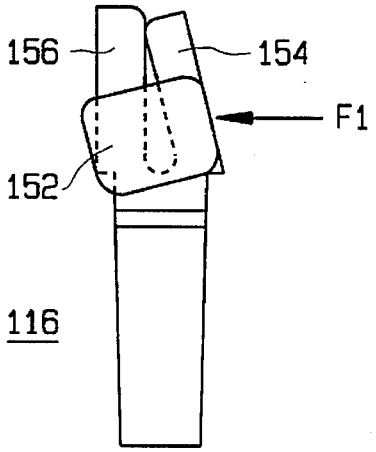
Figure 23:
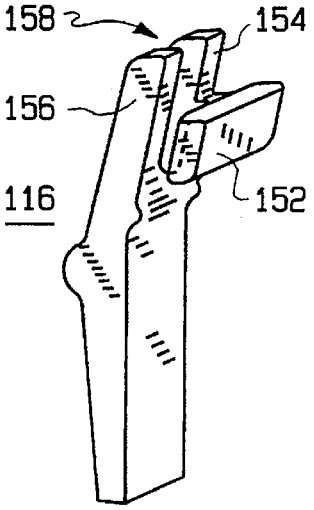

More specifically, FIG. 20 depicts a valve actuator 114 and a latch 116, and FIGS. 21–23 depict the latch in greater detail. Valve actuator 114 is similar in structure and function to valve actuator 14 of FIG. 4. Elements 136, 138, 139 of valve actuator 114 correspond to elements 36, 38, 39, respectively, of valve actuator 14 (FIG. 4).

Latch 116 is preferably provided with an elongated portion 150 corresponding to elongated portion 16F of FIG. 4. Latch 116 is also provided with a finger actuatable portion 152 which is employed by a user to move the latch and, in particular, to move a first tip portion 154 cross-wise towards a second tip portion 156 thereby closing the gap 158 therebetween (FIG. 21). Finger actuatable portion 152 is then used to move first and second tip portions 154, 156 (which are approximately adjacent to each other) inward so as to cause portions 154 and 156 to align with cavity 127 in valve actuator 114. Once so aligned, finger actuatable portion 152 is moved upward,so as to force tip portions 154 and 156 upward and into cavity 127. Once portions 154 and 156 engage cavity 127, pressure may be released from finger actuatable portion 152 and the lighter will remain in its Unlatched configuration until a user depresses valve actuator 114 in a manner similar to that described in conjunction with FIGS. 1–19.

Figure 24:
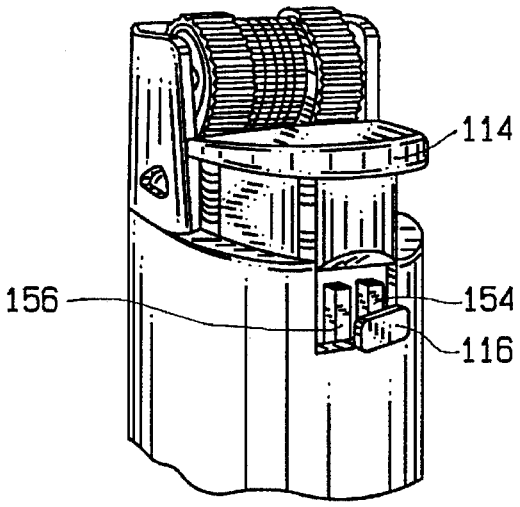
Figure 25:
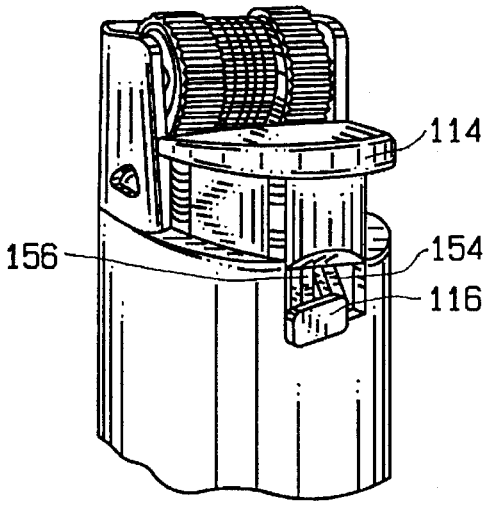

In the latched or closed configuration depicted in FIG. 24, an upper surface of first tip portion 154 and an upper surface of second tip portion 156 each abuts a lower surface 114A of valve actuator 114, thereby preventing depression of valve actuator 114. As in the embodiment depicted in FIGS. 1–19, a small gap may be provided between surface 114A and each of tip portions 154, 156. Downward movement of latch 116 is prevented in a manner similar to that described in conjunction with the embodiment of FIGS. 1–19.

Advantageously, the shape of cavity 127 is such that tip portions 154, 156, if separated by gap 158 as depicted in FIG. 21, cannot be inserted into cavity 127. However, application of a force F1 to finger actuatable portion 152 causes portion 154 to move towards portion 156 thus enabling the approximately adjacent portions 154, 156 to eventually be inserted into cavity 127.

Additionally, such a configuration facilitates resilient movement of latch 116 and/or portions thereof. Such a configuration also facilitates retention of the lighter and, in particular, latch 116, in an unlatched or non-interfering position once the latch is placed in such an unlatched position and until valve actuator 114 is depressed and released.

Figure 26:
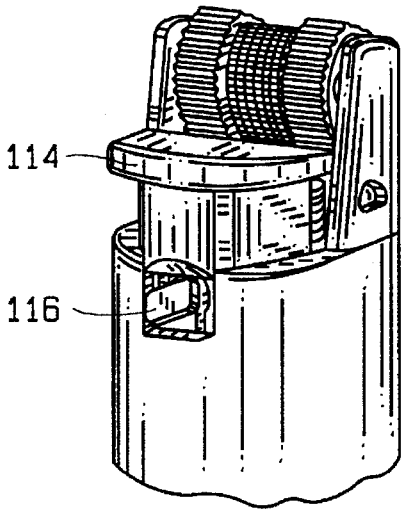
Figure 27:
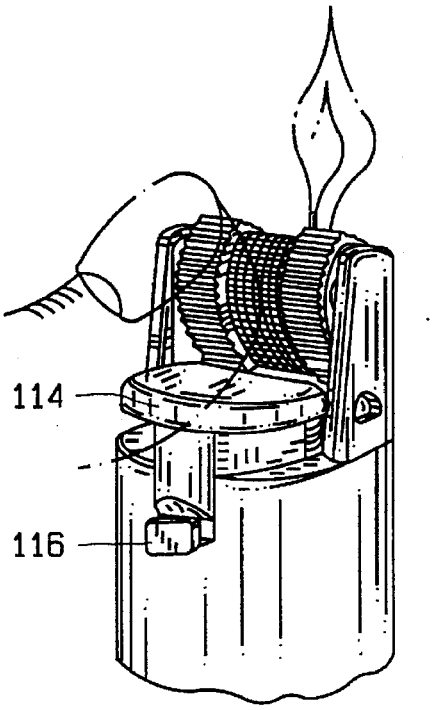

Referring now to FIGS. 24–27, there is depicted the sequence of operations to be performed in order to operate the lighter. Specifically, FIG. 24 depicts the lighter in a latched configuration in which the latch mechanism is at its at-rest latched position thereby preventing depression of the valve actuator. In the configuration depicted in FIG. 25, tip portion 154 is moved to a position approximately adjacent to tip portion 156 so as to enable approximately adjacent tip portions 154, 156 to eventually be inserted into cavity 127 (not shown). In particular, tip portion 154 is moved adjacent to tip portion 156 by application of a user-applied force (F1) to finger actuatable portion 152 in a cross-wise direction (see FIGS. 20–23). Such cross-wise movement is followed by movement of tip portions 154, 156 inward so as to align-the tip portions with cavity 127. The inward movement is effected by application of a user-applied force (F2) to finger actuatable portion 152 in an inward direction (see FIGS. 20–23). Such inward movement is followed by movement of tip portions 154, 156 upward so as to cause tip portions 154, 156 to engage cavity 127, as depicted in FIG. 26. The upward movement is effected by application of a user-applied force (F2) to finger actuatable portion 152 in an upward direction (see FIGS. 20–23). Once tip portions 154, 156 engage cavity 127, the lighter is in its fully unlatched configuration and remains so, as depicted in FIG. 26. Depression of valve actuator 114 at this point combined with and preferably preceded by rotation of the spark-producing wheel assembly will cause the lighter to operate, and will also cause latch 116 to travel downward in channel 35 (FIG. 3), as indicated in FIG. 27. For ease of illustration, the gap between tip portions 154, 156 and valve actuator 114 has been exaggerated in the figures.

Figure 28:
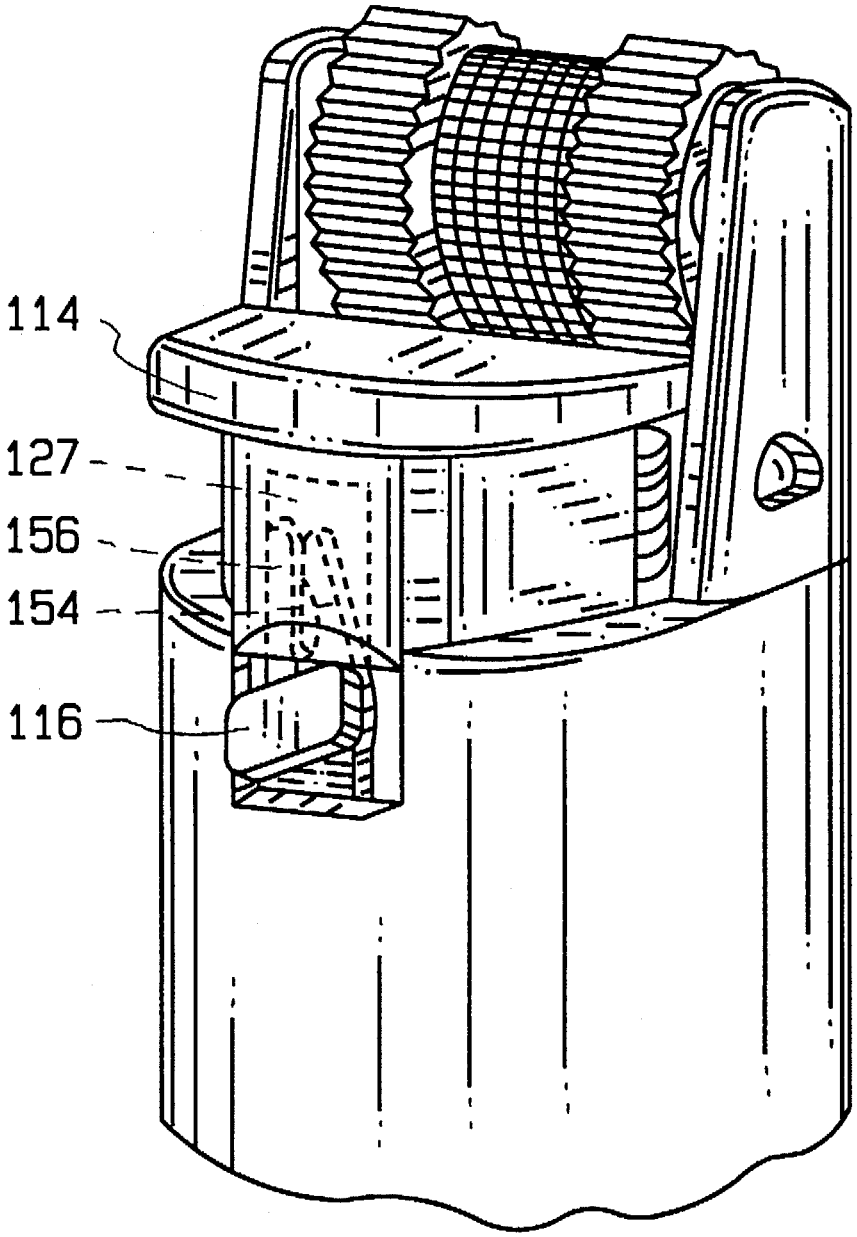

FIG. 28 depicts the unlatched lighter of FIG. 26 in more detail. Specifically, FIG. 28 depicts the requirement that tip portions 154, 156 be approximately adjacent to each other in order to be inserted into cavity 127.

While it is apparent that the invention herein disclosed is well-calculated to fulfill the objects above stated, it will be appreciated that numerous modifications and embodiments may be devised by those skilled in the art, and it is intended that the appended claims cover all such modifications and embodiments as fall within the true spirit and scope of the present invention.

More specifically, the latching mechanism and lighter disclosed and claimed herein are not limited to use in disposable lighters. Additionally, a flame height adjusting mechanism may be provided to selectively adjust the height of the flame. Moreover, the present invention is not limited to a latching mechanism in which a latch is moved first in an inward direction then in an upward direction ninety degrees from the inward direction, or first in a cross-wise direction, then in an inward direction and then in an upward direction, in order to align an interfering portion of the latch with a cavity in the valve actuator so as to enable depression of the actuator. For example, any of a wide variety of latch mechanisms or actions may be employed, such as mechanisms having right-left, front-rear, over and down, in and over, over and up, etc. type actions, or any of such actions coupled with an inward movement. Similarly, the latch may be positioned at other locations within the lighter body so as to prevent depression of the valve actuator by interfering with other portions of the valve actuator. For example, the latch may be positioned at a side of the lighter as opposed to the rear of the lighter depicted in the figures.

We claim:

1. A flame producing lighter, comprising:

a housing having an outer wall defining an upper edge along its periphery, said housing defining a reservoir for containing fuel under pressure;

a valve selectively actuatable between a closed position which prevents exit of said fuel from said reservoir and an open position which permits exit of fuel from said reservoir through said valve;

a valve actuator having a depressible portion which is movable to actuate the valve for movement between first and second positions corresponding, respectively, to said closed and open valve positions;

spark producing mechanism capable of producing sparks at a location proximate a gaseous medium exit opening of said valve thereby selectively causing ignition of said fuel;

a latch member disposed below the valve actuator and movable between (i) a latched position, disposed between the valve actuator and housing such that movement of the valve actuator to the second position is blocked by contact between said valve actuator, a latch member contact portion and said housing upper edge, and (ii) an unlatched position, wherein the latch member is in contact with the valve actuator, allowing movement of the valve actuator to the second position; wherein the latch member is moved inward with respect to the outer wall to the unlatched position from the latched position; and a resilient element biasing the latch member into contact with the valve actuator in the unlatched position,. wherein depression of the valve actuator causes a movement between the latch member and the valve actuator such that said resilient element automatically returns the latch member to the latched position.

2. The lighter according to claim 1, wherein the latch member is moveable with the valve actuator from the first position to the second position.

3. The lighter according to claim 1, wherein said latch member is movable inward and upward toward a cavity in said valve actuator until said valve actuator is depressed, whereby fuel exists said valve and the latch member moves back under the valve actuator when the valve actuator is released.

4. The lighter according to claim 1, wherein said latch member is movable cross-wise, then inward and then upward toward a cavity in said valve actuator until said valve actuator is depressed, whereby fuel exits said valve and the latch member moves back under the valve actuator when the valve actuator is released.

5. The lighter according to claim 1, wherein said latch member is movable inward, then cross-wise and then upward toward a cavity in said valve actuator until said valve actuator is depressed, whereby fuel exits said valve and the latch moves back under the valve actuator when the valve actuator is released.

6. A flame producing lighter, comprising:

a housing defining a reservoir for containing fuel under pressure;

a valve selectively actuatable between a closed position which prevents exit of said fuel from said reservoir and an open position which permits exit of fuel from said reservoir through said valve;

a valve actuator pivotable about a transverse axis, having a depressible portion which is movable to actuate the valve for movement between first and second positions corresponding, respectively, to said closed and open valve positions;

means for producing sparks at a location proximate a gaseous medium exit opening of said valve thereby selectively causing ignition of said fuel;

a latch member movable between (i) a latched position, disposed between the valve actuator and housing such that movement of the valve actuator to the second position is blocked by contact between said valve actuator, latch member contact portion and said housing, and (ii) an unlatched position allowing movement of the valve actuator to the second position; wherein the latch member and latch member contact portions are moved inward and at least a portion of the latch member pivots about an axis parallel to the valve actuator transverse axis from the latched position to the unlatched position; and a resilient element biasing the latch member into contact with the valve actuator in the unlatched position, wherein depression of the valve actuator causes a movement between the latch member and the valve actuator such that said resilient element automatically returns the latch member to the latched position.

7. A child resistant fuel control mechanism for use in combination with a lighter having a main body containing a fuel supply with a valve aligned with a substantially vertical axis moveable between open and closed positions in response to depression of a valve actuator, said mechanism comprising:

a latch positioned under the valve actuator and moveable between (i) a latched position which blocks depression of the valve actuator by contact between said actuator, latch and housing and prevents movement of the valve to the open position, and (ii) an unlatched position inward from the latched position allowing depression of the valve actuator and movement of the valve to the open position, wherein inward movement of said latch provides a space between the latch and the housing, said space being sufficient in size to enable said valve actuator to be depressed at least partially into said space, and at least a portion of the latch member pivots about an axis substantially perpendicular to the valve axis from the latched position to the unlatched position, said latch member being resiliently maintained in the unlatched position and automatically returned to the latched position in response to depression of said valve actuator.

8. The control mechanism according to claim 7 wherein the valve actuator defines a void on an underside and wherein upward movement, subsequent to said inward movement, of said latch toward a position at least partially into said void, said position being resiliently maintained by pressure exerted by said latch on said valve actuator, provides said lighter in an unlatched configuration in which said valve actuator is capable of being depressed, thereby permitting fuel to flow.

9. The control mechanism according to claim 8 wherein said latch comprises two tip portions normally separated by a gap, and at least one of said two tip portions must be moved cross-wise by an external force such that said two tip portions become approximately adjacent to each other in order for said tip portions to enter said void.

* * * * *